United States Patent [19]

Rabe

[11] 4,173,030

[45] Oct. 30, 1979

[54] FUEL INJECTOR DRIVER CIRCUIT

[75] Inventor: Paul R. Rabe, Caledonia, Mich.

[73] Assignee: General Motors Corporation, Detroit, Mich.

[21] Appl. No.: 906,472

[22] Filed: May 17, 1978

[51] Int. Cl.[2] ..... H01H 47/32

[52] U.S. Cl. ..... 361/154; 123/32 EF; 361/196

[58] Field of Search ..... 361/152, 154, 196; 123/32 EA, 32 EF

[56] References Cited

U.S. PATENT DOCUMENTS

| | | | |
|---|---|---|---|
| 3,483,851 | 12/1969 | Reichardt | 123/32 |
| 3,513,815 | 5/1970 | Mair | 123/32 |
| 3,634,733 | 1/1972 | Boyer | 361/154 |
| 3,660,730 | 5/1972 | Mason | 361/152 |
| 3,909,681 | 9/1975 | Campari et al. | 361/154 |
| 3,918,417 | 11/1975 | Gambill et al. | 123/32 EA |

*Primary Examiner*—Harry E. Moose, Jr.
*Attorney, Agent, or Firm*—Howard N. Conkey

[57] ABSTRACT

A circuit is described for energizing an electromagnetically operated fuel injector from an unregulated voltage source in response to an injection command pulse. The injector pull-in current is provided by directly coupling the unregulated voltage across the injector upon the initiation of the injection command pulse. The injector current is thereafter reduced to a lower hold-in value. The circuit is voltage compensated by a pair of timers the first of which compensates for the voltage dependent injector pull-in time by adjusting the time that the unregulated voltage is directly applied across the injector as a function of the value of the unregulated voltage to insure that the injector is energized for all values of the unregulated voltage while minimizing the time period that the unregulated voltage is directly coupled across the fuel injector. The second timer extends the time of injector energization beyond termination of the injection command pulse by a time period dependent upon the value of the unregulated voltage so as to compensate for the voltage dependent injector pull-in time so that the injector is energized for a time period substantially equal to the injection command pulse for all values of the unregulated supply voltage.

3 Claims, 3 Drawing Figures

FUEL INJECTOR DRIVER CIRCUIT

This invention is directed toward internal combustion engine fuel injection systems and more particularly to a driver circuit for energizing electromagnetically operated fuel injectors.

In the type of fuel injection system to which this invention is directed, one or more electromagnetically operated fuel injectors are repeatedly energized for determined time periods to meter fuel to an internal combustion engine. Generally, a series of injection command pulses are generated each having a duration determined from existing engine operating parameters such as mass air flow into the engine, engine temperature, etc. The injectors are then energized in response to the command pulses.

Due to the inductive properties of the electromagnetically operated injector, the energizing current through the injector cannot change instantaneously when a voltage is applied across the injector winding. The interval between the time when the voltage is applied across the injector winding and the time when the energizing current through the injector winding builds to the required injector pull-in level is referred to as the "pull-in" time of the injector. It is generally desirable to minimize this pull-in time in order to optimize the time response of the injector to the injection command pulses.

The time required for the injector current to increase to its pull-in value may be decreased by coupling the vehicle battery voltage directly across the injector resulting in a rapid buildup of the injector current to the pull-in value. However, it is undesirable to maintain the injector energized with the full battery output voltage for the duration of the injector command pulse as the resulting current through the injector is substantially greater than the required injector hold-in current value and results in excessive power dissipation in the fuel injector. Consequently, it is desired to reduce the voltage applied across the fuel injectors after their energization to a value producing the required hold-in current value which is generally substantially less than the pull-in value. In these systems, it is required that the energizing voltage be applied for a sufficient duration to allow the current through the injector windings to build up to the pull-in value before reducing the energizing voltage to the lower value for maintaining the injectors energized.

It has been proposed to time the application of the energizing voltage and, after the expiration of a constant time period, reduce the energizing voltage to the lower voltage producing the hold-in current. However, when the injectors are energized from an unregulated voltage source, such as a vehicle battery, whose voltage may vary widely, the use of a timer employing a constant time for timing the application of the unregulated energizing voltage across the injector requires the time to be set at least to a value wherein it at least equals the pull-in time for the lowest voltage values of the unregulated voltage source where the injector pull-in time is greatest. This results in the application of the energizing voltage for an excessive time period for the higher levels of the energizing voltage wherein injector pull-in time is shorter thereby resulting in excessive power dissipation.

It has also been proposed to monitor the injector current upon the application of the energizing voltage and when the monitored current attains the predetermined injector pull-in level, the voltage is reduced to provide the lower hold-in current. However, this system requires substantially complex current monitoring circuitry.

It is the general object of this invention to provide an improved fuel injector driver circuit having voltage compensation.

It is another object of this invention to provide a fuel injector driver circuit for providing pull-in and hold-in currents for the injector wherein the pull-in current is provided by application of an unregulated voltage across the injector winding for a time period determined as a function of the value of the unregulated voltage so as to ensure injector energization and to minimize the time period that the unregulated voltage is directly coupled across the fuel injector.

It is another object of this invention to provide for an injector driver circuit for energizing fuel injectors in response to an injection command pulse employing a pull-in circuit for energizing the injectors from an unregulated voltage supply and a hold-in circuit effective to provide for a hold-in current after injector energization, wherein the pull-in and hold-in circuits are regulated as a function of the value of the unregulated voltage to provide fuel metering that is independent of the value of the unregulated voltage.

The foregoing and other objects of this invention are accomplished in the preferred embodiment in which a pull-in current timer is responsive to an injection command pulse to directly apply the vehicle unregulated battery voltage across the fuel injectors to provide for injector pull-in. The time duration that the battery voltage is directly applied across the fuel injectors is adjusted as a function of the magnitude of the unregulated voltage to a value to insure that the injector pull-in current is attained while at the same time minimizing the time period that the unregulated voltage is directly coupled across the fuel injector. Further, the hold-in timer extends the energization of the injectors beyond the termination of the injection command pulse for a period dependent upon the value of the unregulated voltage so as to compensate for the pull-in delay of the injectors.

The invention may be best understood by reference to the following description of a preferred embodiment and the drawings in which.

Figure 1:
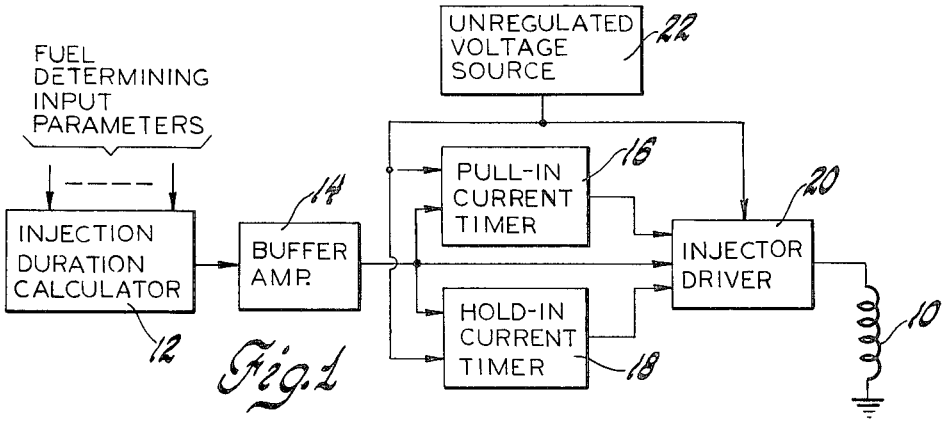
FIG. 1 is a block diagram of the injector energizing system of this invention.

Referring to FIG. 1, there is illustrated the injector energizing circuit of this invention for energizing the winding 10 of an electromagnetically operated fuel injector of an internal combustion engine. While one injector winding is illustrated, the windings of additional injectors may be parallel coupled therewith if they are to be simultaneously controlled. An injection duration calculator 12 is responsive to the vehicle engine fuel determining input parameters such as air flow, temperature, etc. and provides a series of output pulses having a frequency and duration representing the desired engine fuel flow. Each pulse has a duration calculated from the input parameters representing the period during which it is desired to energize the fuel injector winding 10 to inject fuel into the engine. The duration and frequency of the pulse output of the injection duration calculator 12 in conjunction with the fuel flow characteristics of the fuel injector provide for the desired metering of fuel to the internal combustion engine.

The pulse output of the injection duration calculator 12 is coupled to the input of a buffer amplifier 14 whose output is a series of injection command pulses corresponding to the output pulses of the calculator 12 and each of which represents a desired energizing period of the fuel injector winding 10.

The fuel injection command pulses from the amplifier 14 are coupled to a pull-in current timer 16, a hold-in current timer 18 and an injector driver 20. The injector driver circuit 20 is responsive to the pull-in current timer 16 and the injection command pulses to couple the unregulated voltage from an unregulated voltage source, illustrated as the vehicle battery 22, directly across the injector winding 10 for a period determined by the output of the pull-in current timer 16. The coupling of the full voltage from the vehicle battery 22 across the winding 10 provides for rapid energization of the fuel injector in response to the initiation of an injection command pulse output of the amplifier 14.

The time period during which the unregulated voltage from the source 22 is directly coupled across the winding 10 is determined by the pull-in current timer 16 in response to the voltage value of the vehicle battery 22. The timed output has a duration that allows the current to build up in the injector winding 10 to the pull-in value for all voltage values of the vehicle battery 22. However, the duration is modified in accord with the voltage value of the output of the vehicle battery 22 so that the time period that the unregulated voltage is directly coupled across the injector winding 10 is minimized.

After the pull-in current timer 16 is timed out, the injector driver 20 is responsive to the fuel injection command pulse output of the buffer amplifier 14 to couple a lower hold-in voltage across the winding 10 having a value providing the injector hold-in current to maintain the fuel injector energized for the remainder of the injection command pulse.

Upon termination of the injection command pulse output of the amplifier 14, the hold-in current timer 18 maintains the injector driver 20 operative to apply the hold-in voltage across the winding 10 for a time period dependent upon the voltage value of the vehicle battery 22. This time period is substantially equal to the pull-in time of the injector 10, which, as previously described, is variable as a function of the voltage of the vehicle battery 22. In this manner, the injector winding 10 is energized for a duration that is substantially equal to the injection command pulse output of the amplifier 14 for all voltage values of the vehicle battery 22.

Figure 2:
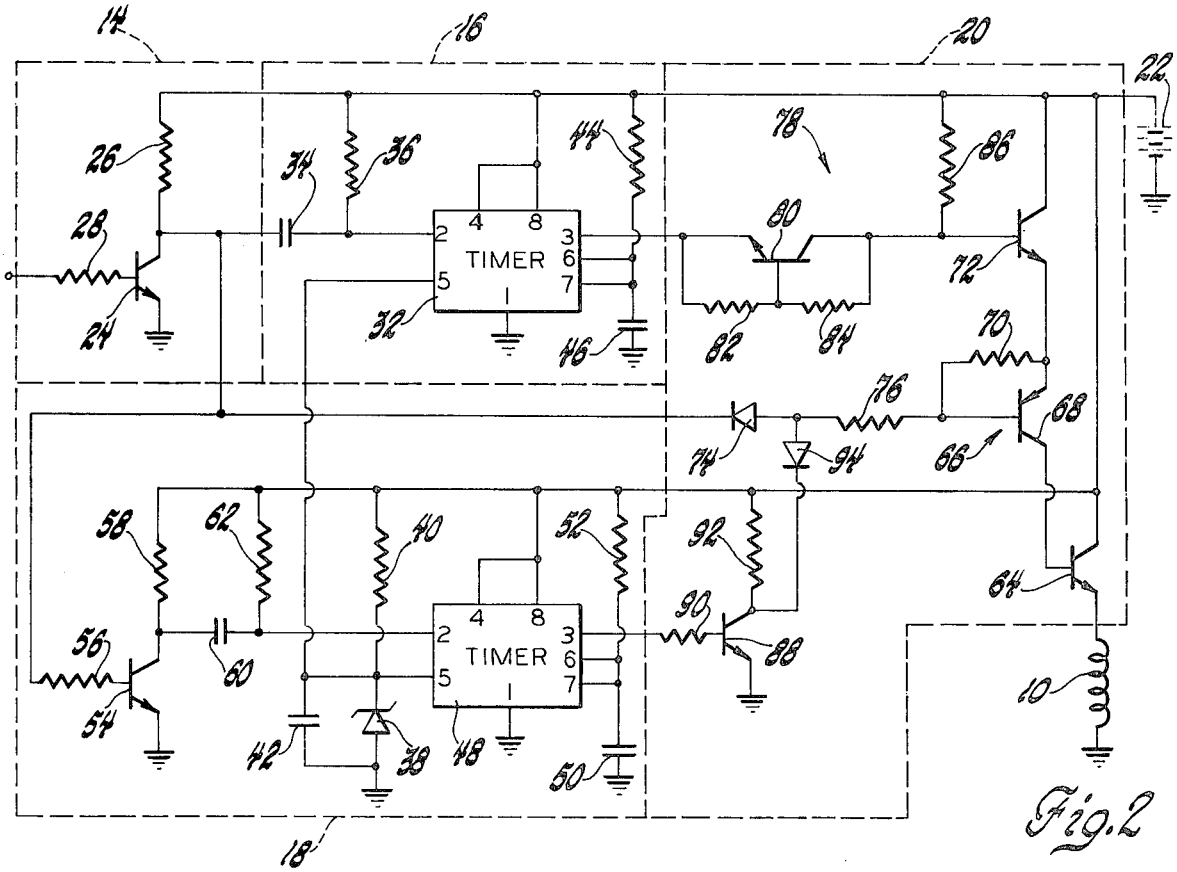
FIG. 2 is a circuit diagram of the system illustrated in FIG. 1.

Referring to FIG. 2, the buffer amplifier 14 includes an NPN transistor 24 whose emitter is grounded and whose collector is coupled to the positive terminal of the vehicle battery 22 through a resistor 26. The output of the injection duration calculator 12 of FIG. 1 is coupled to the base of the transistor 24 through a resistor 28. The output of the buffer amplifier 14 is provided at the collector of the transistor 24 and comprises an inverted form of the output pulse from the injection duration calculator 12 so that the injection command pulse output of the buffer amp 14 is a ground level pulse.

The output of the amplifier 14 is coupled to the trigger input 2 of a monostable multivibrator or single-shot timer 32 in the pull-in current timer 16 through a capacitor 34 of a differentiating network which also includes a resistor 36 coupled between the positive terminal of the vehicle battery 22 and the trigger input 2 of the timer 32.

While other timers may be employed, the timer 32 of FIG. 2 takes the form of a National Semiconductor single-shot timer, Model No. NE 555. This form of timer functions to provide a timed output voltage pulse at output terminal 3 having a duration dependent upon the value of a reference voltage applied to the terminal 5 and the value of the timing elements coupled to the terminal 6. In this respect, a regulated reference voltage is provided to the terminal 5 by means of a Zener diode 38 which is series coupled with a resistor 40 across the vehicle battery 22. A filtering capacitor 42 is coupled in parallel with the Zener diode 38. The pull-in current timer 16 also includes timing elements comprised of a resistor 44 and a capacitor 46 which are series coupled across the vehicle battery 22 with the voltage across the capacitor 46 being applied to the terminal 6 of the timer 32. The terminal 7 of the timer 32 is grounded during the absence of a timed output voltage pulse at the terminal 3 to discharge the capacitor 46.

When the timer 32 is triggered by a negative current pulse input to terminal 2, the voltage at output terminal 3 shifts to a positive voltage level for the time required for the capacitor 46 to be charged by the vehicle battery 22 to the reference voltage provided by the Zener diode 38 at the terminal 5. When the capacitor 46 charges to this reference voltage, the timed output voltage pulse at output terminal 3 terminates and the capacitor 46 is discharged through the terminal 7.

The time required to charge the capacitor 46 after the timer 32 is triggered is a function of the magnitude of the unregulated voltage provided by the vehicle battery 22, the capacitor 46 being charged at a more rapid rate for greater values of the unregulated voltage. Consequently, the duration of the timed output pulse of the timer 32 decreases with increasing values of the unregulated voltage provided by the vehicle battery 22. The values of the reference voltage provided by the Zener diode 38, the capacitor 46 and the resistor 44 are such that the time required for the vehicle battery 22 to charge the capacitor 46 to the reference voltage is related to the time required for the current through the injector winding 10 to increase to the pull-in current value when the voltage from the vehicle battery 22 is directly coupled across the injector winding 10. In this respect, the values are selected so that the duration of the timed output signal from the timer 32 at the output terminal 3 is substantially equal to but greater than the energizing time period required for the current through the injector winding 10 to attain the predetermined pull-in current in response to the directly coupled unregulated voltage provided by the vehicle battery 22 and is adjusted in response to variations in the value of the unregulated voltage by an amount substantially equal to the variation of the pull-in time of the injector in response to the variations in the value of the unregulated voltage output of the vehicle battery 22.

The hold-in current timer 18 includes a single-shot timer 48 that is identical to the single-shot timer 32 in the pull-in current timer 16. In this respect, the timer 48 is triggered by a negative current pulse applied to its input terminal 2 and provides a timed output pulse at the output terminal 3 having a duration required for a timing capacitor 50 to be charged by the vehicle battery 22 through a timing resistor 52 to the value of the reference voltage provided at the terminal 5 by the Zener diode 38. Upon termination of the timed output pulse at the output terminal 3, the capacitor 50 is discharged by the ground signal provided at the terminal 7.

The timer 48 is triggered to initiate a timed output pulse upon the termination of an injection command pulse. In this respect, the output injection command pulse from the amplifier 14 is coupled to the base electrode of an inverting NPN transistor 54 through a resistor 56. The emitter of the transistor 54 is grounded and its collector is coupled to the positive terminal of the vehicle battery 22 through a resistor 58. The output of the transistor 54 is differentiated by a differentiating circuit including a capacitor 60 and a resistor 62 series coupled between the collector of the transistor 54 and the positive terminal of the vehicle battery 22. The differentiated signal is provided to the input terminal 2 of the timer 48.

Upon the termination of the injection command pulse wherein the output of the amplifier 14 shifts from ground potential to a positive voltage level, the transistor 54 is biased conductive and its collector shifts to nearly ground potential. The resulting negative current pulse triggers the timer 48 which produces the timed pulse output at the terminal 3.

In the same manner as described with reference to the timer 32, when the timer 48 is triggered, the capacitor 50 is charged by the vehicle battery 22 at a rate related to the magnitude of the unregulated voltage output thereof. The time required for the capacitor 50 to be charged to the reference value provided by the Zener diode 38 is inversely proportional to the voltage of the battery 22. Consequently, the timed pulse output of the timer 48 has a duration decreasing with increasing values of the unregulated voltage provided by the vehicle battery 22.

The values of the capacitor 50 and the resistor 52 and the value of the reference voltage provided by the Zener diode 38 are such that the time required for the battery 22 to charge the capacitor 50 to the reference voltage is related to the pull-in time of the injector winding 10 when the battery voltage is directly coupled across the injector winding 10. In this embodiment, the timed pulse output of the timer 48 is substantially equal to the timed pulse output of the timer 32.

The voltage applied across the injector winding 10 is controlled by means of an emitter follower driver transistor 64 in the injector driver 20 coupled between the injector winding 10 and the positive output terminal of the vehicle battery 22. The voltage applied to the base of the transistor 64, and consequently the voltage applied across the injector winding 10, is controlled by means of an on/off switch 66 comprised of a PNP transistor 68 having a feedback resistor 70 and an NPN transistor 72, the transistors 68 and 72 being series coupled between the positive terminal of the vehicle battery 22 and the base of the transistor 64.

During the period of the injection command pulse output of the amplifier 14, the on/off switch 66 is biased to an on condition by the ground signal applied to the base of the transistor 68 through a diode 74 and a resistor 76. During the time period that the on/off switch 66 is on, the voltage applied to the injector winding 10 is controlled by the conduction of the transistor 72. The transistor 72 is controlled by means of the timed pulse output of the timer 32 in conjunction with a buffer-voltage regulator 78 comprised of an NPN transistor 80, biasing resistors 82 and 84, and a resistor 86. The buffer-voltage regulator 78 is coupled between the positive terminal of the vehicle battery 22 and the output terminal 3 of the timer 32. The junction between the collector of the transistor 80 and the resistor 86 is coupled to the base of the transistor 72, the potential thereat controlling the conduction level of the transistor 72.

During the time period of the timed pulse output of the timer 32, the potential at the base of the transistor 72 is substantially at the potential of the vehicle battery 22 so that the transistor 72 is biased full on thereby applying substantially the full value of the unregulated voltage of the battery 22 through the transistor 68 to the base of the transistor 64. Consequently, the transistor 64 is biased to coupled the full value of the unregulated voltage of the vehicle battery 22 across the injector winding 10. When the timed pulse output of the timer 32 terminates, the buffer-voltage regulator 78 applies a regulated voltage to the base of the transistor 72 to bias the transistor 72, which is coupled in an emitter follower configuration, to apply a regulated voltage to the base of the transistor 64 which in turn provides a regulated voltage across the injector winding 10. This voltage has a value determined to produce a current through the injector winding 10 that is substantially equal to but greater than the hold-in current of the fuel injector.

Upon termination of the injection command pulse output of the amplifier 14, the ground signal input to the on/off switch 66 through the diode 74 terminates. However, the on/off switch 66 is maintained in an on state after termination of the injection command pulse for a duration equal to the timed output signal from the timer 48 by means of an NPN transistor 88 whose conduction is controlled by the timed pulse output of the timer 48 which is applied to its base through a resistor 90. The emitter of the transistor 88 is grounded and the collector thereof is coupled to the positive terminal of the battery 22 through a resistor 92.

The transistor 88 is biased conductive for the duration of the timed output pulse of the timer 48. The resulting ground signal at its collector is coupled to the base of the transistor 68 in the on/off switch 66 through a diode 94 and the resistor 76, which ground signal maintains the on/off switch 66 on for the duration of the timed output pulse of the timer 48. Upon termination of the timed output pulse of the timer 48, the transistor 88 is biased into its nonconduction state thereby biasing the on/off switch 66 off. Consequently, the transistor 64 is biased off to deenergize the injector winding 10 to terminate fuel injection.

The operation of the circuit of FIG. 2 will now be described with reference to FIG. 3 which illustrates the injector command pulse (ground level pulse) output of the amplifier 14, the current through the injector winding 10 for two values of the unregulated battery voltage and the injector energization period.

At time $t_1$, the injector command pulse is initiated when the output of the amplifier 14 shifts to ground potential. Simultaneously, the on/off switch 66 is biased on and the timer 32 is triggered to provide the timed output pulse. The timed pulse output of the timer 32 functions to bias the transistors 72 and 64 on to directly couple the full value of the unregulated voltage output of the vehicle battery 22 across the injector winding 10. The current through the injector winding 10 begins to increase as illustrated by the solid line segment and at time $t_2$, which is dependent upon the value of the unregulated voltage output of the vehicle battery 22, increases to the pull-in value of the injector winding 10.

At this time, the injector is energized to initiate injection of fuel to the internal combustion engine.

At time $t_3$, which is substantially equal to but greater than the time $t_2$, the timed output pulse of the timer 32 is terminated resulting in the regulated voltage determined by the regulator 78 being applied across the injector winding 10. This regulated voltage functions to provide the hold-in current of the injector winding 10 that is substantially less than the pull-in current level but greater than the minimum current required to maintain the fuel injector energized.

At time $t_4$, the injection command pulse terminates (shifts to a positive voltage) to remove the ground signal applied to the on/off switch 66 through the diode 74. However, termination of the injection command pulse functions to trigger the timer 48 which provides the timed output pulse therefrom to maintain the on/off switch 66 on. Consequently, the regulated voltage is maintained across the injector winding 10 beyond the termination of the injection command pulse for the duration of the timed output pulse from the timer 48.

At time $t_5$, the timed output of the timer 48 terminates to thereby bias the on/off switch 66 off to deenergize the injector winding 10 and terminate fuel injection. The time between the times $t_4$ and $t_5$, which is the duration of the timed output of the timer 48, is substantially equal to the time duration between the times $t_1$ and $t_2$ which represents the pull-in time of the fuel injector for the particular value of the unregulated voltage output of the battery 22.

Figure 3:
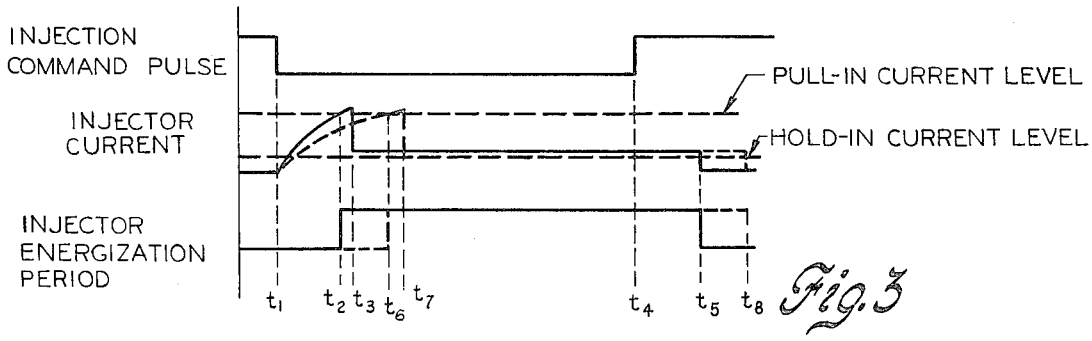
FIG. 3 is a diagram of the waveforms of the system of FIG. 2 illustrating the principles of this invention.

FIG. 3 also illustrates the operation of the circuit of FIG. 2 for a lower value of the unregulated voltage output of the vehicle battery 22. As illustrated in the broken line curve, at $t_1$ the injector command pulse is initiated to bias the on/off switch 66 on and to trigger the timer 32 to couple the value of the unregulated voltage of the battery 22 across the injector winding 10. However, as a result of the decreased value of the voltage of the battery 22, the pull-in time of the fuel injector is greater as illustrated by the lower rate of increase in the current through the injector winding 10. At time $t_6$, the current through the injector winding 10 attains the injector pull-in current value and the injector is energized to initiate fuel injection. A short time thereafter at time $t_7$, the timed output pulse from the timer 32 terminates resulting in the application of the regulated injector hold-in voltage across the injector winding 10. Again, at time $t_4$, the injection command pulse terminates resulting in the triggering of the timer 48 which maintains the injector energized as previously described. At time $t_8$, the timed output pulse of the timer 48 terminates resulting in the deenergization of the injector winding 10 and the termination of fuel injection. As before, the time between the times $t_4$ and $t_8$ is substantially equal to the time between the times $t_1$ and $t_6$.

As can be seen in the two examples, the time that the fuel injector is energized remains substantially equal to the duration of the injector command pulse for all values of the unregulated voltage output of the vehicle battery 22. Also, as illustrated in FIG. 3, the time period that the unregulated voltage output of the battery 22 is coupled directly across the injector winding 10 remains substantially equal to but greater than the pull-in time of the fuel injector.

In the foregoing manner, the energizing time period of the fuel injector is reduced to a minimum value by direct application of the full battery voltage across the injector winding. However, the time duration that this maximum voltage is applied across the injector winding is maintained substantially equal to but greater than the time period required for the current through the injector winding to increase to the required injector pull-in value so that the fuel injector is energized during each injection command pulse for all values of the unregulated voltage while at the same time the time period that the unregulated voltage is directly coupled across the injector winding is minimized to thereby minimize the power dissipation in the injector winding.

The timing elements of the timer 48 may also be selected to compensate for injector fuel flow rate variations resulting from battery voltage fluctuations when an electric fuel pump is employed. In this case, the injector may be energized for a period varying from the duration of the injection command pulse. However, the quantity of fuel injected for a given injection command pulse duration is constant for all values of battery voltage.

The foregoing description of a preferred embodiment of the invention for the purpose of illustrating the principles thereof is not to be considered as limiting or restricting the invention, since many modifications may be made by the exercise of skill in the art without departing from the scope of the invention.

The embodiments of the invention in which an exclusive property or privilege is claimed are defined as follows:

1. A circuit for energizing an electromagnetically operated fuel injector having a predetermined pull-in current requirement and a lower hold-in current requirement, the circuit comprising:

a voltage source effective to provide an unregulated voltage having time varying characteristics;

means effective to provide an injection command pulse;

a timer activated by the injection command pulse effective to provide a timed output signal; and means responsive to the timed output signal and the injection command pulse effective (1) to directly couple the unregulated voltage across the fuel injector for the duration of the timed output signal, the current through the fuel injector increasing at a rate related to the value of the unregulated voltage and (2) to couple a reduced voltage across the fuel injector for the remainder of the injector command pulse to provide the fuel injector hold-in current, the timer including timing control means responsive to the unregulated voltage value effective to provide the timed output signal with a duration substantially equal to but greater than the energizing time period required for the current through the injector to attain the predetermined pull-in current in response to the directly coupled unregulated voltage and that is adjusted in response to variations in the value of the unregulated voltage by an amount substantially equal to the variation of the energizing time period in response to variations in the value of the unregulated voltage, whereby the time that the unregulated voltage is directly coupled across the fuel injector is continuously adjusted so that the fuel injector is energized during each injection command pulse for all values of the unregulated voltage and whereby the time period that the unregulated voltage is directly coupled across the fuel injector is minimized.

2. A circuit for energizing an electromagnetically operated fuel injector having a predetermined pull-in current requirement and a lower hold-in current requirement, the circuit comprising:

a voltage source effective to provide an unregulated voltage having time varying characteristics;

means effective to provide an injection command pulse;

a timer activated by the injection command pulse effective to provide a timed output signal;

means responsive to the timed output signal and the injection command pulse effective (1) to directly couple the unregulated voltage across the fuel injector for the duration of the timed output signal, the current through the fuel injector increasing at a rate directly proportional to the value of the unregulated voltage and (2) to couple a reduced voltage across the fuel injector for the remainder of the injector command pulse to provide the fuel injector hold-in current, the timer including timing control means responsive to the unregulated voltage value effective to provide the timed output signal with a duration substantially equal to but greater than the pull-in time period required for the current through the injector to attain the predetermined pull-in current in response to the directly coupled unregulated voltage and that is adjusted in response to variations in the value of the unregulated voltage by an amount substantially equal to the variation of the energizing time period in response to variations in the value of the unregulated voltage, the time that the unregulated voltage is directly coupled across the fuel injector being continuously adjusted so that the fuel injector is energized during each injection command pulse for all values of the unregulated voltage and the time period that the unregulated voltage is directly coupled across the fuel injector being minimized; and an extender circuit responsive to the termination of the injection command pulse effective to maintain the reduced voltage across the fuel injector for a time period related to the value of the unregulated voltage and that is adjusted in response to variations in the value of the unregulated voltage by an amount substantially equal to the variation of the pull-in time period in response to variations in the value of the unregulated voltage.

3. A circuit for energizing an electromagnetically operated fuel injector having a predetermined pull-in current requirement and a lower hold-in current requirement, the circuit comprising:

a voltage source effective to provide an unregulated voltage having time varying characteristics;

means effective to provide an injection command pulse;

means effective to provide a reference voltage;

a timing circuit comprised of a capacitor and a resistor in series;

means activated by the leading edge of the injection command pulse effective (1) to couple the timing circuit in parallel with the voltage source, (2) to provide a timed output signal having a duration equal to the time required for the capacitor to be charged by the voltage source to the reference voltage, the capacitor being charged at a rate related to the value of the unregulated voltage, and (3) to discharge the capacitor at the termination of the timed output signal; and means responsive to the timed output signal and the injection command pulse effective (1) to directly couple the unregulated voltage across the fuel injector for the duration of the timed output signal, the current through the fuel injector increasing at a rate directly proportional to the value of the unregulated voltage and (2) to couple a reduced voltage across the fuel injector for the remainder of the injector command pulse to provide the fuel injector hold-in current, the reference voltage and the time constant of the timing circuit having values so that the timed output signal has a duration substantially equal to but greater than the pull-in time period required for the current through the injector to attain the predetermined pull-in current in response to the directly coupled unregulated voltage and that is adjusted in response to variations in the value of the unregulated voltage by an amount substantially equal to the variation of the pull-in time period in response to variations in the value of the unregulated voltage, whereby the time that the unregulated voltage is directly coupled across the fuel injector is continuously adjusted so that the fuel injector is energized during each injection command pulse for all values of the unregulated voltage and whereby the time period that the unregulated voltage is directly coupled across the fuel injector is minimized.

* * * * *